United States Patent [19]

Gauthier

[11] Patent Number: 4,486,210

[45] Date of Patent: Dec. 4, 1984

[54] METHOD AND APPARATUS FOR GAS LIQUEFACTION

[75] Inventor: Pierre Gauthier, Fresnes, France

[73] Assignee: L'Air Liquide, Societe Anonyme pour l'Etude et l'Exploitation des Procedes Georges Claude, Paris, France

[21] Appl. No.: 522,626

[22] Filed: Aug. 12, 1983

Related U.S. Application Data

[63] Continuation of Ser. No. 343,599, Jan. 28, 1982, abandoned.

[30] Foreign Application Priority Data

Feb. 5, 1981 [FR] France ..... 81 02202

[51] Int. Cl.[3] ..... F25J 3/00

[52] U.S. Cl. ..... 62/23; 62/38; 62/40; 165/140

[58] Field of Search ..... 62/40, 38, 39, 23, 13–15, 62/9, 11; 165/140

[56] References Cited

U.S. PATENT DOCUMENTS 4,330,308 5/1982 Grenier et al. ..... 62/40

FOREIGN PATENT DOCUMENTS 2384221 3/1977 France .

*Primary Examiner*—Frank Sever

*Attorney, Agent, or Firm*—Young & Thompson

[57] ABSTRACT

Method and apparatus for liquefying a gas such as natural gas, utilizing at least one cycle fluid comprising a refrigerating mixture, with at least one first principal cycle fluid under a low pressure in countercurrent heat exchange with the gas which is to be liquefied and with at least one second principal cycle fluid under a high pressure. At least one secondary cycle fluid is obtained by withdrawing a portion in liquid phase from the refrigerating mixture at the high pressure and is expanded to the low pressure and is then added to the first principal cycle fluid. The heat exchange takes place in at least one heat exchanger comprising a stack of plates which form uninterrupted longitudinal compartments forming passages for the first principal cycle fluid under a low pressure, these compartments extending from the cold end of the exchanger, and a plurality of longitudinal compartments forming passages for at least one of the second principal cycle fluid and the fluid to be liquefied, these latter compartments extending to the cold end of the exchanger. The addition of the secondary fluid to the first principal fluid takes place in a distributed manner into each low pressure compartment in at least one transverse volume extending along the thickness of the exchanger, this volume being located at heat exchange distance from the inlets and outlets of the compartments forming passages for the first principal fluid under low pressure.

27 Claims, 9 Drawing Figures

23
(25)
(27)
(29)
(31)
103
105
101
68
102
105
56
(57)
(58)
46
N1
N2
104
103
40 (41)(42)
43 (44)(45)
III
III
T2
105'
102
101
105
106'
106
68
61
56a
(57a)
(58a)
63
8&10
16
56b
(57b)
(58b)
62

METHOD AND APPARATUS FOR GAS LIQUEFACTION

This application is a continuation of application Ser. No. 343,599, filed Jan. 28, 1982, abandoned.

BACKGROUND OF THE INVENTION

The present invention relates to methods of and apparatus for liquefying a gas such as natural gas, utilising a refrigerating mixture cycle fluid with at least one principal cycle fluid under a pressure referred to as low cold-producing pressure, in counterflow heat exchange with a heat-producing fluid which is to be liquefied on the one hand, on the other hand with at least one heat-producing principal cycle fluid under a pressure referred to as high pressure, with addition to a said principal cycle fluid under a low pressure and at an intermediate heating temperature of at least one secondary cycle fluid obtained by withdrawal of a part in the liquid state of the said refrigerating mixture at a higher pressure than its low pressure, which is expanded to a low pressure before the said addition.

In known embodiments of this method, use has always been made of exchangers of the coiled type positioned in line, allowing for withdrawals and additions of fluid at the cold end of each exchanger. The redistribution of fluids under low pressure however requires comparatively complex arrangements which are very costly in any event. By contrast, the exchangers of the type comprising stacks of plates and tie bars forming:

at least one plurality of uninterrupted longitudinal compartments forming passages for such a principal cycle fluid under low pressure, the said compartments extending from a cold end of the said exchanger;

at least one plurality of longitudinal compartments forming passages for at least one of the following fluids, being at least one such principal cycle fluid under high pressure and the said fluid which is to be liquefied, the said compartments terminating at a cold end of the said exchanger, are of comparatively inexpensive construction, but in this case also it is incumbent on the user to provide several exchangers in line, for the re-introduction of the secondary fluids. It is for this reason that, if it has been decided to utilise a single exchanger only providing for liquefaction of the gas processed by itself, for the purpose of cost limitation, it has been sought to provide a simplified method lacking the forming of secondary cycle fluid requiring re-introducing actions, but the application of a method of this kind is comparatively difficult since its specific energy is high.

Accordingly, it is an object of the invention to provide a method of gas liquefaction which simultaneously offers the advantages of a single line exchanger for the complete temperature gradient up to liquefaction of the gas which is to be processed and of a method utilising at least one withdrawal and re-introduction of a secondary cycle fluid.

SUMMARY OF THE INVENTION

In a method and apparatus of the nature defined above, the invention consists in that the said heat exchange is effected in an exchanger of the kind comprising a stack of plates and tie bars, forming:

at least one plurality of uninterrupted longitudinal compartements forming passages for such a principal cycle fluid under a low pressure, said compartments extending from a cold end of said exchanger;

at least one plurality of longitudinal compartments forming passages for at least one of the following fluids, being at least one such principal cycle fluid under a high pressure and the said fluid which is to be liquefied, the said compartments terminating at a cold end of said exchanger:

the said addition of a secondary fluid to a principal fluid occurring in distributed manner in each low-pressure compartment in at least one transverse volume extending along the thickness of the exchanger and situated at heat exchange distance from the inlets and outlets of the said compartments forming passages for a principal fluid under a low pressure.

The invention also consists in an exchanger for carrying out the above method, said exchanger being of the compact type and comprising plates brazed on tie bars forming a plurality of flat compartments of generally rectangular shape stacked in a transverse direction referred to as the exchanger thickness or depth and having another transverse dimension or exchanger width, and a longitudinal dimension or exchanger length, characterised in that a plurality of compartments lacking any partition, individually adjacent to at least one other plurality of compartments is provided, apart from the inflow and outflow means, with intermediate inlet means between said inflow-outflow means opening laterally to the exchanger along one and the same intermediate volume of the exchanger length and for each compartment comprising distribution means spread out throughout the width of the compartment.

BRIEF DESCRIPTION OF THE DRAWINGS

In order that the invention may be more clearly understood, reference will now be made to the accompanying drawings which show certain embodiments thereof by way of example and in which.

DETAILED DESCRIPTION OF PREFERRED EMBODIMENTS

Figure 1:
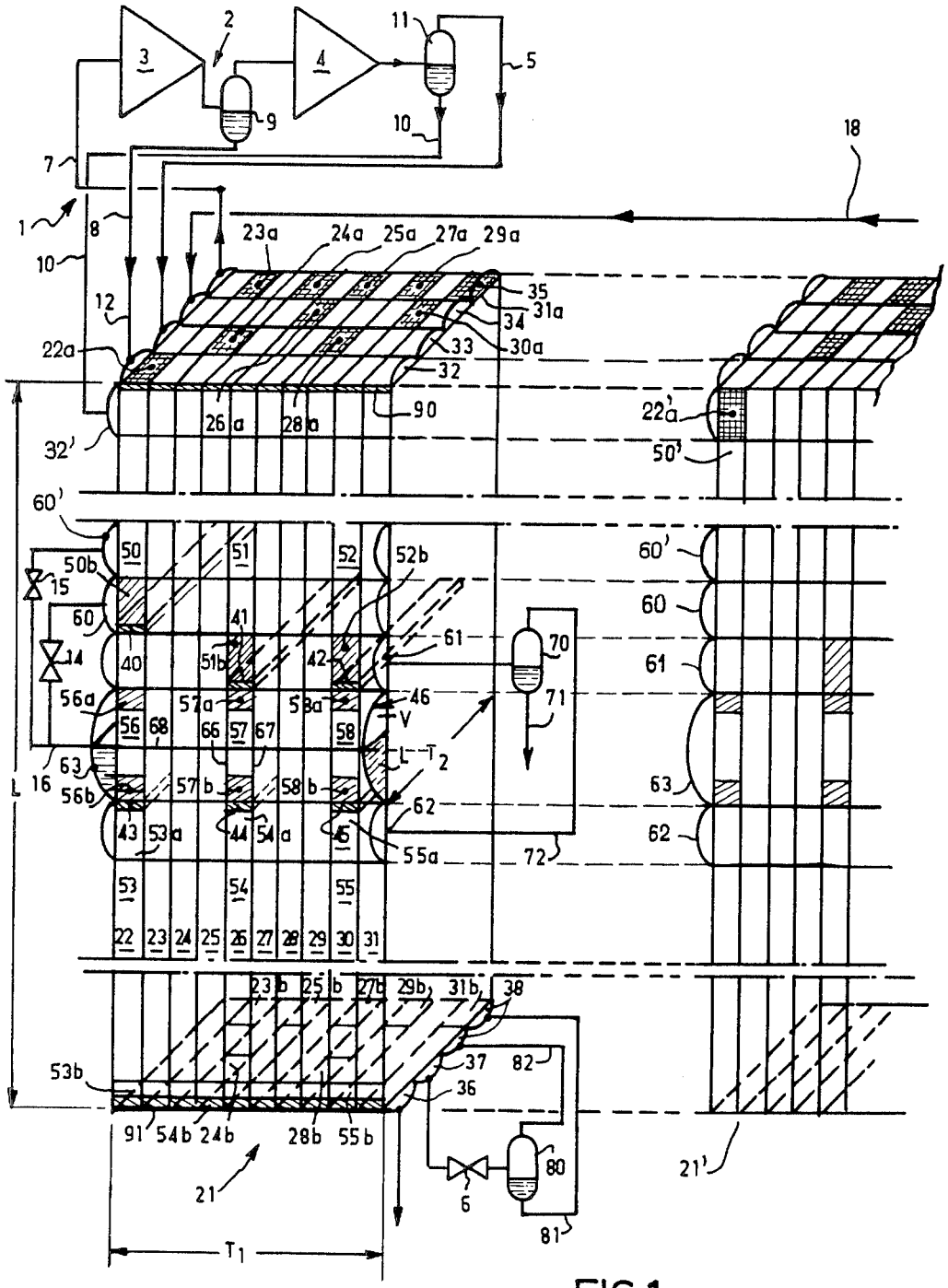
FIG. 1 is a block schematic view of a first embodiment of exchanger.
Figures 2, 3:
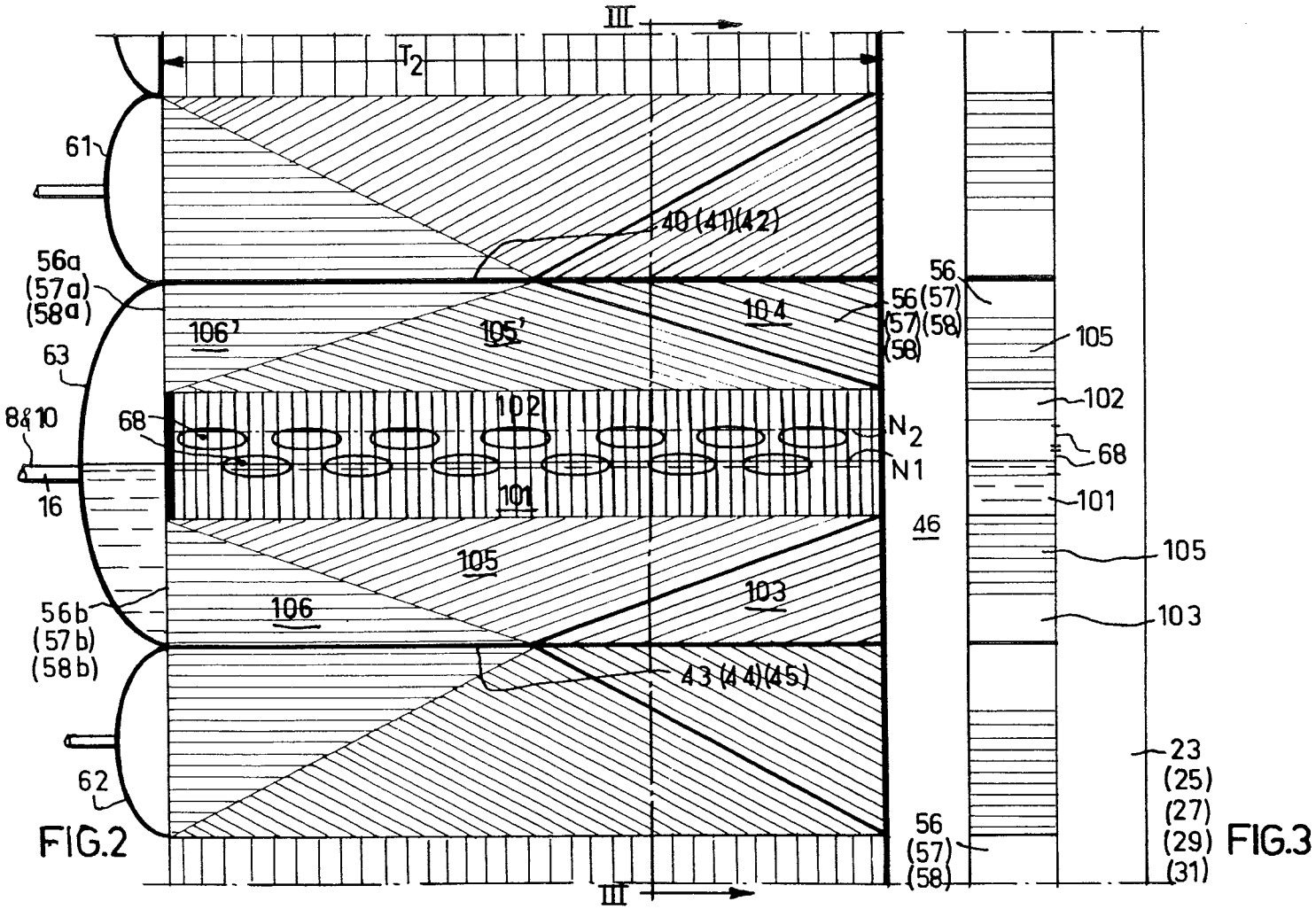
FIGS. 2 and 3 are views in cross-section along the lines II—II and III—III respectively of FIGS. 1 and 2, FIGS. 4 and 5 on the one hand, and FIGS. 6 and 7 on the other hand, are views in cross-section of two further and modified embodiments.

Referring now to the drawings, FIGS. 1, 2 and 3 show a plant for liquefying a gas, for example natural gas, which comprises a closed circuit or loop 1 for a cycle fluid formed by a refrigerating mixture of cycle mixture incorporating hydrocarbons from $C_1$ to $C_4$ and nitrogen if appropriate, with essentially one cycle compressor 2 comprising two stages 3 and 4, a duct 7 for a principal cycle fluid under low pressure, or low-pressure (cold producing) duct, leading to a stage 3 of the compressor 2, a duct 5 for a cycle fluid under high pressure or high-pressure (heat-producing) duct, an expansion valve 6, a withdrawal duct 8 for a secondary cycle fluid withdrawn in the liquid state and under medium pressure at the base of a medium pressure separator 9 interposed between the two compression stages 3 and 4, and a withdrawal duct 10 for a secondary cycle fluid withdrawn in the liquid state and under high pressure at the base of a high-pressure separator 11 situated at the outlet of the high-pressure stage 4, these ducts for withdrawal of secondary cycle fluid 8 and 10 each having a first section under pressure (heat producing) 12 and 13, under medium pressure and high pressure respectively, and beyond two expansion valves 14 and 15, a second low-pressure section 16 leading directly into the duct 7 for the principal low-pressure cycle fluid.

In the example described, the principal cycle fluid within the low-pressure duct 7 induces cooling down to liquefaction of a gas which is to be liquefied which flows in a duct 18 and also the cooling of the principal high-pressure cycle fluid in the duct 5, as well as the supercooling of the secondary cycle fluid in the liquid cycle state within the first sections under medium pressure 12 and under high pressure 13.

As will be apparent, the whole of these cooling operations or more generally speaking of heat transfer, occurs in one and the same heat exchanger 20 of the type comprising brazed plates and formed by a plurality of modules, one of which is illustrated in particular at 21 in FIG. 1 and which are positioned side by side. Each heat exchange module 21 forms—in the example described—a stack in the transverse direction ($T_1$) of ten flat compartments of rectangular shape along a second transverse dimension or width ($T_2$) and a longitudinal direction (L), denoted by the numerals 22 to 31, which at the longitudinal extremities and in (or close to) their upper or "hot" end bars 90 all comprise "hot" openings, each leading into one of the four boxes 32 to 35, comprising a box 32 for inflow of the secondary cycle fluid under low pressure and in the liquid state, a box 33 for inflow of principal cycle fluid under high pressure, a box 34 for inflow of the natural gas, a box 35 for outflow of low-pressure principal cycle fluid. The compartments 22 to 31 also comprise within (or close to) their lower or "cold" end bars 91, "low" or "cold" openings leading in each case into three boxers 36,37 and 38, comprising a box 36 for outflow of liquefied natural gas, a box 37 for outflow of high-pressure cycle fluid, and a double box 38 for inflow of low-pressure principal cycle fluid.

Consequently, for the module 21, and starting from the left towards the right and upwards (or at the hot end 90), the compartment 22 leads via a "hot" opening **22*a* (hatched area) into the box 32 for inflow of the secondary cycle fluid in the liquid state and under medium pressure, the compartments 23,25,27,29 and 31 leading via "hot" openings 23*a*,25*a*,27*a*,29*a*,31*a* into the box 35 for outflow of the low-pressure cycle fluid, the compartments 24 and 28 leading via "hot" openings 24*a* and 28*a* into the box 33 for inflow of high-pressure cycle fluid, and the compartments 26 and 30 leading via "hot" openings at 26*a* and 30*a* into the box 34** for inflow of natural gas.

At a particular distance from the hot end 90 of the exchanger and also at a distance from the cold end 91, the compartments 22, 26 and 30 are each divided by two cross-bars 40,41,42 and 43,44,45 situated at two different longitudinal or temperature levels (the bar 40 being at a higher level than the bars 41 and 42 whereas the bars 43,44 and 45 are all at the same level) with incorporation between these levels of an intermediate volume referred to as an addition volume 46, thereby establishing within the compartments 22, 26 and 30 and one in extension of the other, "high" (or "hot") compartment sections 50,51,52 respectively, the compartment section 50 being shorter than the compartment sections 51 and 52, "low" (or "cold") compartment sections 53,54,55 respectively, which are all of identical length, and intermediate compartment sections 56,57,58, respectively.

The "hot" compartment section 50 leads downwards via a lateral opening **50*b* into a box 60 for outflow of cycle fluid in the liquid state and under medium pressure, whereas the "hot" compartment sections 51 and 52 lead downwards and via lateral openings 51*b* and 52*b* into a natural gas outflow collector 61 situated just below the outflow box 60**.

The "low" compartments sections 53,54 and 55 lead upwards at **53*a*,54*a*,55*a* into a box 62** for inflow of natural gas.

The intermediate compartment sections 56,57,58 are incommunication via double lateral openings **56*a*,56*b*; 57*a*,57*b*; 58*a*,58*b* in both upward and downward directions with a separator box 63 connected via the pipe 16 incorporating the valve 14 to the box 60 for outflow of the secondary cycle fluid, and these intermediate sections 56,57,58 have walls 66 and 67 adjacent the low-pressure compartments 23,25,27,29 and 31 and which are provided with a plurality of perforations 68 evenly distributed throughout the width between a high level $N_1$ and a low level $N_2$ of lesser vertical extension than the "clearance height" or addition volume 46**.

In downward direction, meaning towards the cold end 91, the low-pressure compartments 23,25,27,29 and 31 on the one hand open at **23*b*,25*b*,27*b*,29*b* and 31*b* into the low-pressure inflow box 38, the compartments 24 and 28 opening at 24*b* and 28*b* into the high-pressure outflow box 37, on the other hand the compartment sections 53,54 and 55 open at 53*b*,54*b*,55*b* into the natural gas outflow box 36**.

The duct 7 for the principal low-pressure cycle fluid incorporates a plurality (equal to five times the number of modules 21) of heat exchange passages formed by such compartments as 23,25,27,29 and 31 from the supply coming from the "cold" inflow box 38 as far as the discharge via the "hot" outflow box 35; the duct for the high-pressure cycle fluid 5 incorporates a plurality (equal to twice the number of modules 21) of heat exchange passages formed by such compartments as 24 and 28 from the supply coming from the "hot" inflow box 33 as far as the cold outflow box 37, and the duct 18 for the gas which is to be liquefied on the one hand comprises the "high" or "hot" compartment sections such as the two compartment sections 51 and 52 and the "low" or "cold" compartment sections such as 53,54 and 55 between the inflow box 34 and the outflow box 36. A phase separator 70 with provision for extraction at 71 of the liquid fraction formed by the undesirable "heavy" condensates, and for re-introduction at 62 of the gaseous fraction 72, is advantageously arranged between the outflow box 61 and the inflow box 62.

Particular modules like 21 are supplied at the point of their compartment section 50 with medium-pressure cycle fluid 8 by means of the inflow box 32, whereas other modules like 21' of identical structure to that of the modules 21 (at the right in FIG. 1) are supplied in the manner above, except for the high or "hot" compartment section 50' (homologous to the high or hot compartment section 50 of the modules 21) which is supplied via the opening **22'*a* and the collector 32' with the secondary cycle fluid under high pressure and in the liquid state 10, the two medium-pressure and high-pressure 10 fluids then each being expanded, the one via the valve 14 and the other via the valve 15, to the same pressure equal to the low cycle pressure, before being fed into the common separator box 63**.

It will also be observed that the expansion of the fluid at high pressure at the point of the valve 6 commonly has the result of producing a two-phase mixture, and the re-injection of the low-pressure principal cycle fluid at the cold end 91 of the exchanger 20 should occur via a separator 80, a duct for a liquid fraction 81 and a duct for a vapour fraction 82 leading of the double inflow box 38 via means known per se for re-combination of the liquid and vapour phases.

It is thus possible to summarise the different loops at this juncture:

the duct 5 for a high-pressure cycle fluid comprises in the exchanger 20 a pair of end boxes 33,37 at either side of a plurality of longitudinal compartments like 24 and 28 extending practically from one side to another throughout the height of the exchanger 20;

The duct 7 for a low-pressure cycle fluid in the exchanger 20 comprises a pair of end boxes 35,38 at either side of a plurality of longitudinal compartments such as 23,25,27,29,31;

the duct 8 for secondary cycle fluid under medium pressure in the modules 21 comprises an upflow part under the said medium pressure comprising a high or "hot" inflow box 32, a plurality of "upflow" compartment sections 50, an intermediate outflow box 60, an expansion valve 14 and a low-pressure downflow part incorporating the duct 16 and the intermediate separator box 63 and a plurality (identical to the sum of the upflow compartment sections 50 and 51,52) of intermediate compartment sections 56,57,58 and re-injection orifices 68;

the duct 10 for secondary cycle fluid under high pressure in the modules 21' comprises an upflow part under the said high pressure comprising a high or "hot" inflow box 32', a plurality of upflow compartment sections 50', an intermediate outflow box 60' an expansion valve 15 and a low-pressure downflow part incorporating the duct 16 and the intermediate separator box 63 and a plurality (identical to that of upflow compartment sections 50' and 51',52') of intermediate compartment sections 56' and of re-injection orifices 68;

the natural gas loop 18 within the exchanger 20 comprises a high or "hot" inflow box 34, a plurality of upflow compartment sections such as 51 and 52, an intermediate outflow box 61, the separator 70, an intermediate inflow box 62 and a plurality (equal to the sum of the plurality of upflow compartments sections 50 for the secondary cycle fluid under medium pressure 8 (or 50' under high pressure 10 in the modules 21') and of the plurality of upflow compartment sections 51,52 for the natural gas which is to be liquefied 18) of downflow compartment sections such as 53,54,55, and the low or "cold" outflow box 36.

With more particular reference to FIGS. 2 and 3, it will be apparent that the intermediate addition volume 46 comprising the compartment sections 56,57,58 for receiving the expanded secondary cycle fluid (8 and 10) comprises, at either side of the row of orifices 68 extending transversely along the width ($T_2$), flow channels 101–102 allocated, respectively, to "liquid" 103 and "vapour" 104 flow channels, each comprising essentially two distributor channels 105 and 106, 105' and 106', the channels 106 and 106', leading respectively, via the openings **56*a*,56*b* (57*a*,57*b*) (58*a*,58*b*) to "low" and "high" points of the separator box 63**.

Figure 4:
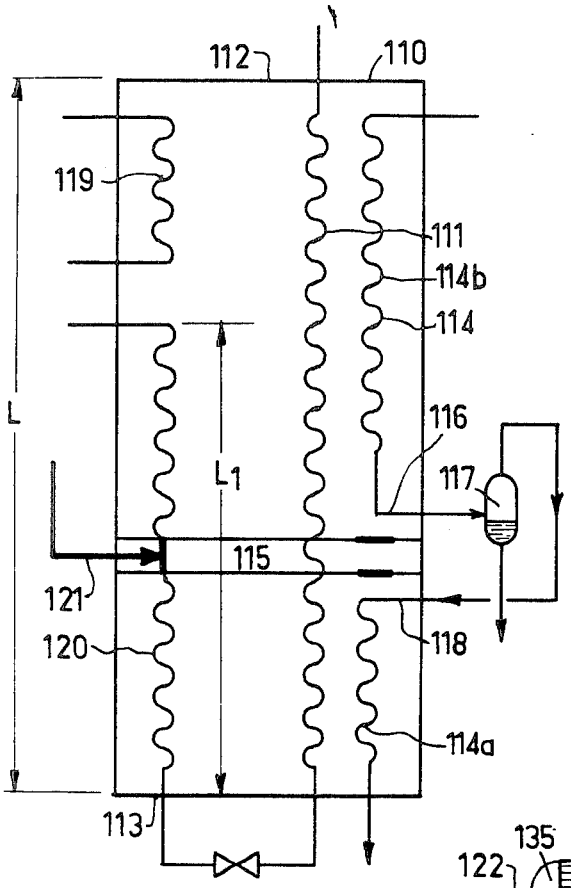

According to the modified embodiment illustrated in FIG. 4, the heat exchanger 110 in this case comprises a plurality of compartments 11 for a cycle fluid under high pressure extending from one side to another and without interruption from a hot end 112 to a cold end 113 of the exchanger 110 and a plurality of compartments 114 for a gas which is to be liquefied extending from the hot end 112 to the cold end 113 with, in an intermediate space 115, withdrawal at 116, separation of the heavier fractions at 117 and re-introduction of the vapour fraction at 118. An independent primary cold-producing cycle 119 is available in this case, and the compartments for the principal low-pressure cycle fluid 120 extend along no more than a limited part ($L_1$) of the length (L) of the exchanger 110 in the extension of the compartment sections serving the purpose of equally conveying the primary cycle fluid 119. The secondary cycle fluid 121 is equally re-introduced into an addition space coinciding with the space for withdrawal of heavier fractions 115, in the same manner as described with reference to FIG. 1, but in this case, since there is no compartment section for the super-cooling of the secondary cycle fluid 121, the gas which is to be liquefied is re-introduced only into the downflow compartment sections **114*a* extending as continuation of the downflow compartment sections 114*b* situated at the other side of the addition-withdrawal space 115**.

Figure 6:
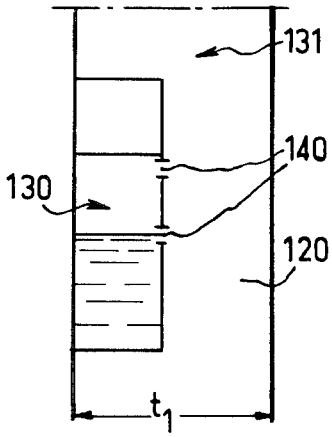
Figure 7:
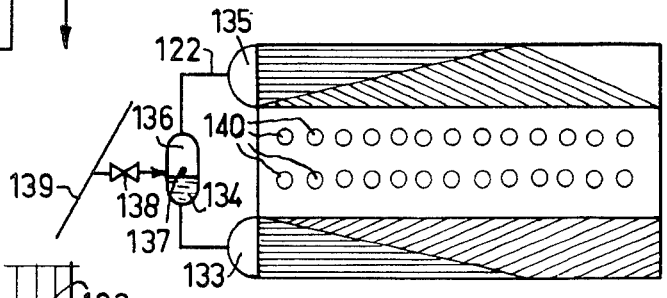
Figure 5:
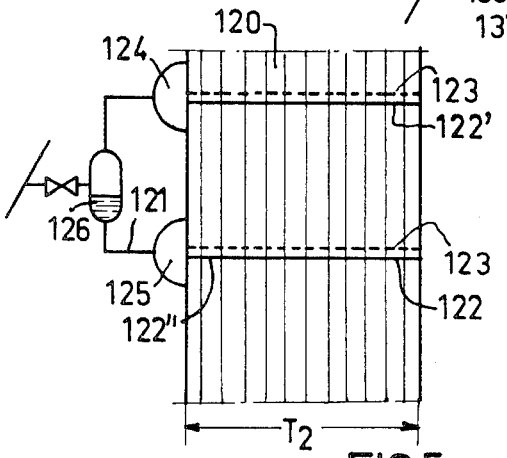
Figure 8:
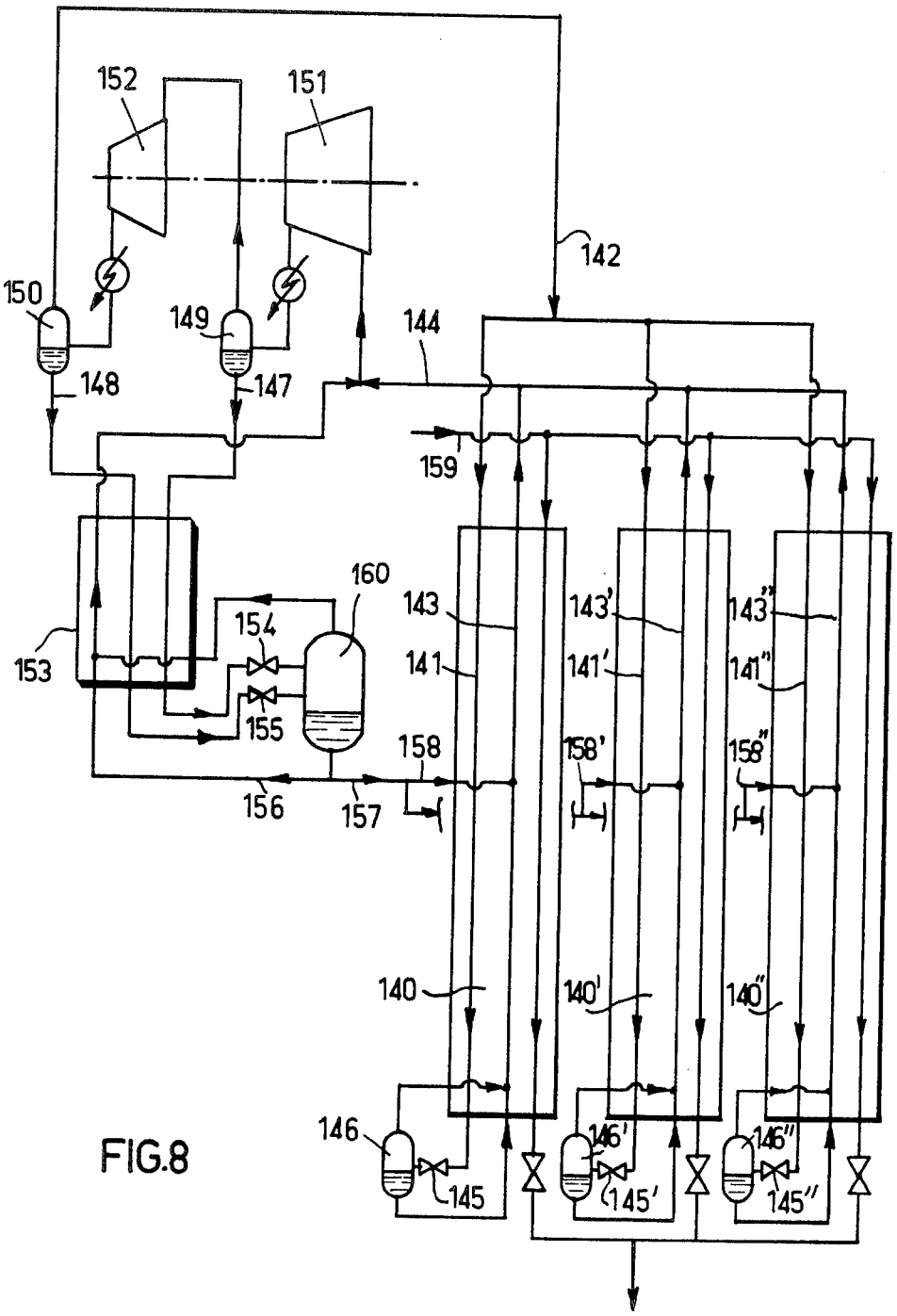
FIGS. 8 and 9 are diagrammatical views of an installation according to the invention, utilising a battery of exchangers.

In a case of this kind, the addition of secondary cycle fluid 121 occurs directly into the compartments for the principal low-pressure cycle fluid 120—for example as depicted in FIGS. 5 via one or more tubes 122 having distributed perforations 123 extending throughout the width ($T_2$) of the exchanger, for each compartment preferably comprising a "vapour" tube 122' in the high position and a "liquid" tube 122'' in the low position connected, respectively, via inflow boxes 124 and 125 to the high and low points of a separator 126, or as depicted in FIGS. 6 and 7, through narrow re-injection compartment sections 130 formed in a part of the thickness ($T_1$) of the compartments 131 for the low-pressure principal cycle fluid 120, supplied via a low inflow box 133 for a liquid fraction 134 of this secondary cycle fluid and a high inflow box 135 for a "vapour" fraction 136 of this secondary cycle fluid, the separation occurring in a phase separator 137 supplied via an expansion valve 138 by a collector 139 for the pressure secondary cycle fluid, the addition occurring in the compartments 120 via rows of perforations 140.

According to the embodiment illustrated in FIG. **8*a* the liquefying plant comprises a battery of exchangers 140,140',140'' installed in parallel and comprising a plurality of longitudinal compartments 141,141',141'' for a high-pressure cycle fluid 142, a plurality of longitudinal compartments 143,143',143'' for a low-pressure cycle fluid 144, with individual re-injection at the cold end of the exchanger 140,140', 140'' via an expansion valve 145,145',145'', a separator 146,146',146''. Also available in this case are two secondary cycle fluids 147 and 148 drawn in the liquid state from the bottom of the separators 149 and 150 at the outlet of the medium-pressure compression stage 151 and of the high-pressure stage 152. The secondary cycle fluids 147 and 148 are subcooled in an auxiliary exchanger 153 and thereupon expanded at 154 and 155 to the low pressure and separated into two partial liquid flows 156 and 157, the partial flow 156 being directed by way of cold-producing fluid into the auxiliary exchanger 153 whereas the partial flow 157 is separated into as many subdivided flows 158,158',158" as there are exchangers 140,140',140" . . . , and added individually in the intermediate spaces of the said exchanger, to each of the low-pressure principal cycle fluids 143,143',143"**.

Figure 9:
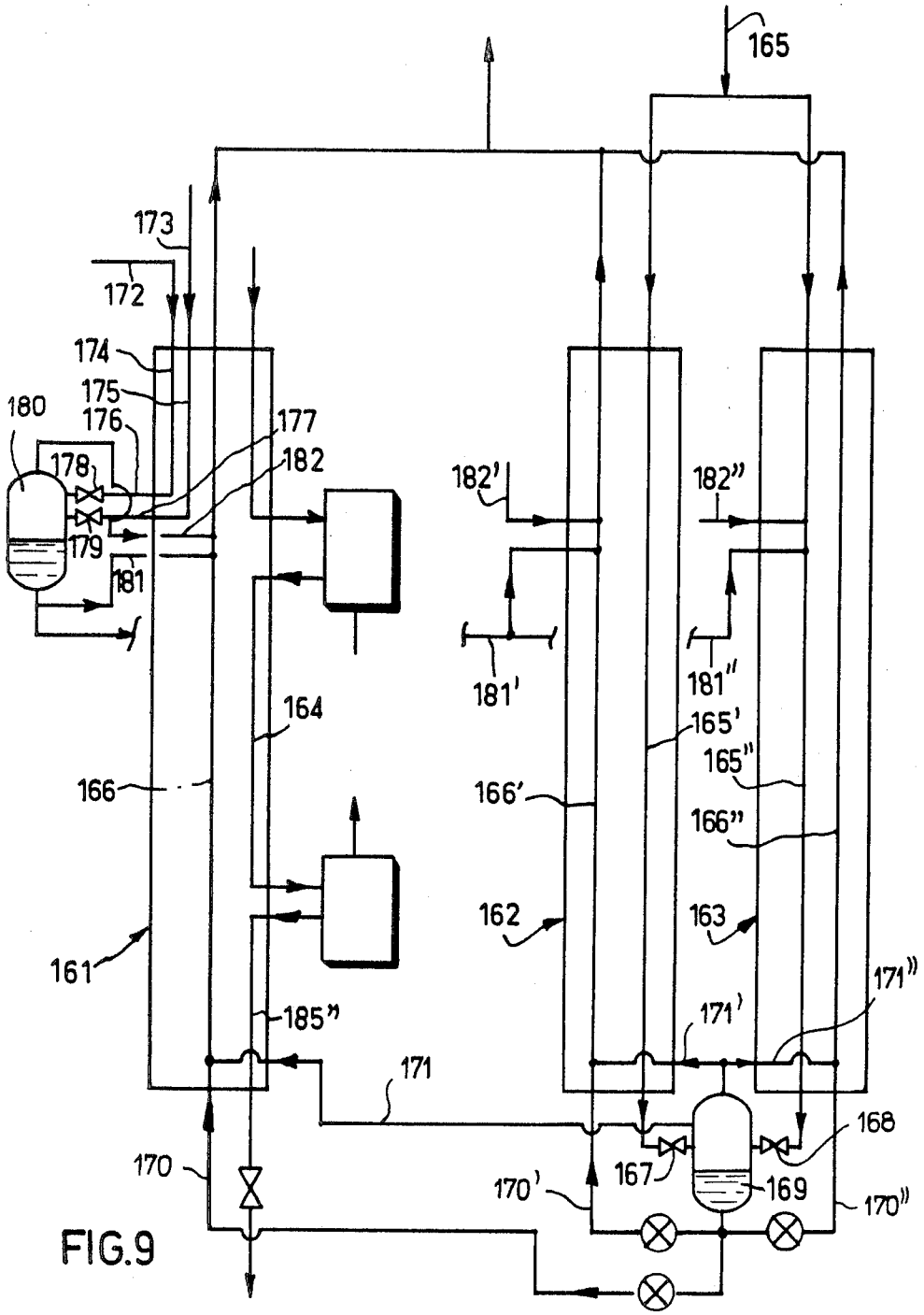

As shown in FIG. 9, a battery of several exchangers is available, for example at 161,162,163 the exchanger 161 being intended for cooling the gas 164 which is to be liquefied, and the other two exchangers 162 and 163 being arranged to cool the high-pressure cycle fluid 165 subdivided for this purpose into two flows 165' and 165", by means of three flows of principal low-pressure cycle fluids 166,166',166" coming from two high-pressure cycle fluids 165' and 165" expanded in 167, 168 in a separator 169 from which are drawn three partial liquid flows 170,170' and 170" and three partial gaseous flows 171,171',171", the flows 170 and 171, 170' and 171', 170" and 171" being re-combined at the cold end of the exchangers 161,162, 163, to form the three low-pressure principal cycle fluids 166,166',166". Secondary cycle liquids 172 and 173 under medium and high pressures occupying upflow compartment sections 174 and 175 of the exchanger 166, are withdrawn from the exchanger 161 at 176 and 177, expanded in 178, 179 to the low pressure and conveyed into a common separator 180 from which are drawn three liquid flows 181,181',181" and the three vapour flows 182,182',182", re-combined in pairs for addition, respectively, to the three principal cycle fluids 166, 166',166".

What is claimed is:

1. In a method for liquefying a gas such as natural gas, utilizing at least one cycle fluid comprising a refrigerating mixture, with at least one first principal cycle fluid under a pressure referred to as low cold-producing pressure in counterflow heat exchange with, on the one hand, said gas which is to be liquefied and on the other hand with at least one heat-producing second principal cycle fluid under a pressure referred to as high pressure, with addition to said first principal cycle fluid under a low pressure and at an intermediate temperature of at least one secondary cycle fluid obtained by withdrawing a part in the liquid state from the said refrigerating mixture at said high pressure, which expanded to said low pressure before the said addition; the improvement comprising:

providing a heat exchanger comprising plates forming flat compartments of generally rectangular shape stacked in a transverse direction referred to as exchanger thickness and having another transverse dimension or exchanger width, and a longitudinal dimension or exchanger length, with a first plurality of compartments which are individually adjacent to at least a second plurality of compartments and having inlet means and outlet means, the said first plurality of compartments being provided with intermediate inlet means between said inlet and outlet means, opening laterally to the exchanger along one and the same intermediate region of the exchanger length and comprising, for each compartment of said first plurality of compartments, distribution means spread throughout the width of said compartment, the exchanger further comprising a third plurality of compartments individually adjacent to said first plurality of compartments;

supplying said first principal cycle fluid to said first plurality of compartments;

supplying said gas to said second plurality of compartments;

supplying said second principal cycle fluid to said third plurality of compartments; then expanding said second principal cycle fluid to said low pressure to constitute said first principal cycle fluid; and supplying said second cycle fluid to said first plurality of compartments through said intermediate inlet means.

2. A method according to claim 1, wherein said second heat-producing principal cycle fluid is arranged to flow wholly and solely through said third plurality of compartments from a warm end to a cold end of said exchanger.

3. A method according to claim 1, in which said gas to be liquefied is made to flow in a first plurality of upstream compartment sections of said second plurality of compartments, is withdrawn from the exchanger and at least a part of the said gas is reintroduced into the said exchanger, said withdrawal occurring at one longitudinal position, in the direction from a warm end towards a cold end of said exchanger, which is upstream of the said intermediate inlet means whereas the said reintroduction occurs downstream of the said intermediate inlet means.

4. A method according to claim 3, in which said secondary cycle fluid is subcooled in a second plurality of upstream compartment sections of said first plurality of compartments and is withdrawn from the said second plurality of compartment sections upstream of said intermediate inlet means.

5. A method according to claim 4, wherein said plurality of compartment sections extend from the warm end of the exchanger.

6. A method according to claim 4, wherein the reintroduction of said gas to be liquefied occurs into a double plurality of downstream compartment sections of said exchanger which are situated downstream with respect to said intermediate inlet means and which extend said first plurality of upstream compartment sections for said gas to be liquefied and said second plurality of upstream compartment sections for the secondary cycle fluid.

7. A method according to claim 3, wherein the said withdrawal occurs at a temperature level at which the said gas to be liquefied is in the partially condensed state and wherein only the vapor fraction of said gas is reintroduced into the said exchanger.

8. A method according to claim 3, wherein the reintroduction of the gas to be liquefied occurs into a plurality of compartment sections of downstream said exchanger situated downstream with respect to said intermediate inlet means, which sections extend said first plurality of upstream compartment sections for the gas to be liquefied.

9. A method according to claim 1, comprising utilizing several said exchangers in parallel and a single compressor, separating the expanded secondary cycle fluid into a liquid fraction and a vapor fraction, and dividing at least said liquid fraction into subdivided fractions which are added separately to the first principal cycle fluid in each exchanger.

10. A method according to claim 9, wherein the vapor fraction is wholly passed in an auxiliary exchanger in counter-current to said secondary cycle fluid.

11. A method according to claim 9, wherein at least one first said exchanger is utilized to cool the gas which is to be liquefied under exclusion of the second principal cycle fluid, and at least one other said exchanger is utilized to cool the second principal cycle fluid under exclusion of the gas which is to be liquefied, said first exchanger being also utilized to cool said secondary cycle fluid which, after expansion and phase separation, has at least its liquid fraction subdivided into as many partial fractions as there are exchangers, said fractions being added to the first principal cycle fluid of the respective exchangers.

12. A method according to claim 1, wherein the secondary cycle fluid is added to the first principal cycle fluid under liquid or gaseous single-phase form.

13. A method according to claim 1, wherein the secondary cycle fluid is added to the first principal cycle fluid in gaseous and liquid two-phase form, with phase separation and recombination of the two phases upon introduction into said first plurality of compartments.

14. A method according to claim 1, further comprising utilizing an auxiliary cycle fluid flowing in compartment sections of said exchanger which extend said first plurality of compartments, the latter extending from a cold end to an intermediate longitudinal position of the exchanger.

15. A heat exchanger of the kind comprising means designed, sized and arranged for liquefying a gas such as natural gas, including plates forming flat compartments of generally rectangular shape stacked in a transverse direction referred to as exchanger thickness and having another transverse dimension or exchanger width, and a longitudinal dimension or exchanger length; a first plurality of compartments which are individually adjacent to at least one second plurality of compartments, each compartment having inlet means and outlet means; the said first plurality of compartments being provided with intermediate inlet means located between said inlet and outlet means, opening laterally to the exchanger along one and the same intermediate region of the exchanger length and comprising, for each compartment off said first plurality of compartments, distribution means spread throughout the width of said compartment; and means for connecting said heat exchanger to an installation having elements designed, sized and arranged for liquefying a gas such as natural gas, including means for circulating a low-pressure first principal cycle fluid in said first plurality of compartments, means for supplying said intermediate inlet means with a secondary cycle fluid under said low pressure and means for circulating in said second plurality of compartments a heat-producing fluid which is at least one of said gas and a high-pressure second principal cycle fluid.

16. A heat exchanger according to claim 15, wherein said intermediate inlet means comprise, in each compartment of said first plurality of compartments and throughout its width, of least one tube comprising radial perforations distributed throughout the width dimension of the said tube.

17. A heat exchanger according to claim 16, wherein said at least one tube comprises two tubes arranged parallel to and slightly spaced from each other along the exchanger length.

18. A heat exchanger according to claim 15, wherein said intermediate inlet means comprise, for each compartment of said first plurality, an intermediate compartment section extending along the width and provided throughout the width with a series of orifices for communication with the said compartment of said first plurality.

19. A heat exchanger according to claim 18, wherein the intermediate compartment sections have a thickness which is distinctly smaller than the thickness of a compartment of said first plurality and are situated in each compartment of the said first plurality of compartments.

20. A heat exchanger according to claim 18, wherein each intermediate compartment section is delimited, in a compartment adjacent the respective compartment of said first plurality, by two walls or bars for separation from two extreme compartment sections, the said series of orifices being formed in at least one wall separating the intermediate compartment from said respective compartment.

21. A heat exchanger according to claim 20, wherein the extreme compartment sections situated at one side of the respective intermediate compartment sections are connected by a first supply box to a second supply box opening into at least the extreme compartment sections situated at the other side of said intermediate compartment sections.

22. A heat exchanger according to claim 18, wherein said intermediate inlet means further comprise, for each compartment of said first plurality, a supply box for said intermediate section forming a phase separator box and extending in a longitudinal direction to cover two infeed passages of said intermediate section.

23. A heat exchanger according to claim 15, wherein said intermediate inlet means comprise two supply boxes which are spaced apart longitudinally, the supply boxes of the intermediate inlet means being lateral to the exchanger.

24. A heat exchanger according to claim 15, further comprising a third plurality of compartments individually adjacent to said first plurality of compartments, and means for connecting inlet means of said third plurality of compartments to means of said installation for supplying the latter with the other of said gas and said high-pressure second principal fluid.

25. An installation for liquefying a gas such as natural gas, the installation comprising means designed, sized and arranged for liquefying a gas such as natural gas, including a compressor having at least one stage; a phase separator at an outlet of said compressor stage; a heat exchanger comprising plates forming flat compartments of generally rectangular shape stacked in a transverse direction referred to as exchanger thickness and having another transverse dimension or exchanger width, and a longitudinal dimension or exchanger length, with a first plurality of compartments which are individually adjacent to at least a second plurality of compartments, the compartments having respective inlet means and outlet means, the said first plurality of compartments being provided with intermediate inlet means between said inlet and outlet means, opening laterally to the exchanger along one and the same intermediate region of the exchanger length and comprising, for each compartment of said first plurality of compartments, distribution means spread throughout the width of said compartment, the exchanger further comprising a third plurality of compartments individually adjacent to said first plurality of compartments; first conduit means connecting outlet means of said first plurality of compartments to a compressor inlet; second conduit means connecting said inlet means of said second plurality of compartments to a source of said gas; third conduit means connecting a top portion of said separator to inlet means of said third plurality of compartments; fourth conduit means connecting a bottom portion of said separator to said intermediate inlet means, said fourth conduit means comprising a first expansion valve; and fifth conduit means connecting outlet means of said third plurality of compartments to inlet means of said first plurality of compartments and having a second expansion valve, the latter inlet means being located at a same longitudinal end of the exchanger as the outlet means of said second and said third plurality of compartments, said first, third, fourth and fifth conduit means and the compartments connected thereto containing a cycle fluid comprising a refrigerating mixture.

26. In a method for liquefying a gas such as natural gas, utilizing at least one cycle fluid comprising a refrigerating mixture, with at least one first principal cycle fluid under a pressure referred to as low cold-producing pressure in counterflow heat exchange with, on the one hand, said gas which is to be liquefied and on the other hand with at least one heat-producing second principal cycle fluid under a pressure referred to as high pressure, with addition to said first principal cycle fluid under a low pressure and at an intermediate temperature of at least one secondary cycle fluid obtained by withdrawing a part in the liquid state from the said refrigerating mixture at said high pressure, which is expanded to said low pressure before the said addition; the improvement comprising:

providing a heat exchanger comprising a stack of plates which form:

at least one first plurality of uninterrupted longitudinal compartments forming passages for said first principal cycle fluid under a low pressure, the said compartments extending from a cold extremity of the said exchanger; and at least one second plurality of longitudinal compartments forming passages for a heat-producing fluid which is at least one of said second principal cycle fluid under a high pressure and said gas which is to be liquefied, said compartments leading to a cold end of said exchanger;

supplying said first principal cycle fluid to said first plurality of compartments;

supplying said heat-producing fluid to said second plurality of compartments; and adding said at least one secondary fluid to said first principal fluid in a distributed manner into each compartment of said first plurality in at least one transverse volume extending along the thickness of the exchanger, the said volume being situated at heat exchange distance from the inlets and outlets of the said compartments of said first plurality of compartments.

27. In an installation for liquefying a gas such as natural gas comprising means designed, sized and arranged for liquefying a gas such as natural gas and utilizing at least one cycle fluid comprising a refrigerating mixture, with at least one first principal cycle fluid under a pressure referred to as low cold-producing pressure in counterflow heat exchange with, on the one hand, said gas which is to be liquefied and on the other hand with at least one heat-producing second principal cycle fluid under a pressure referred to as high pressure, with addition to said first principal cycle fluid under a low pressure and at an intermediate temperature of at least one secondary cycle fluid obtained by withdrawing a part in the liquid state from the said refrigerating mixture at said high pressure, which is expanded to said low pressure before the said addition; the improvement in which the installation comprises a heat exchanger in which said heat exchange occurs, comprising a stack of plates which form:

at least one first plurality of uninterrupted longitudinal compartments forming passages for said first principal cycle fluid under a low pressure, the said compartments extending from a cold extremity of the said exchanger;

at least one second plurality of longitudinal compartments forming passages for a heat-producing fluid which is at least one of said second principal cycle fluid under a high pressure and said gas which is to be liquefied, said compartments leading to a cold end of the said exchanger;

said intermediate inlet means for adding said at least one secondary fluid to said first principal fluid in a distributed manner into each compartment of said first plurality in at least one transverse volume extending along the thickness of the exchanger, the said volume being situated at heat exchange distance from the inlets and outlets of the said compartments forming passages for said first principal fluid under a low pressure;

the installation further comprising:

means for circulating said first principal cycle fluid in said first plurality of compartments;

means for circulating said heat-producing fluid in said second plurality of compartments; and means for feeding said at least one secondary fluid to said intermediate inlet means.

* * * * *